US008205387B2

(12) United States Patent
Ranaudo et al.

(10) Patent No.: US 8,205,387 B2
(45) Date of Patent: Jun. 26, 2012

(54) DELAYED EGRESS SLIDING DOOR AND METHOD

(75) Inventors: Anthony Robert Ranaudo, Bethlehem, CT (US); Prasad Anand Sahasrabudhe, Avon, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 462 days.

(21) Appl. No.: 11/783,881

(22) Filed: Apr. 12, 2007

(65) Prior Publication Data

US 2008/0250716 A1 Oct. 16, 2008

(51) Int. Cl.
*E05B 65/10* (2006.01)

(52) U.S. Cl. ..... 49/141; 49/360

(58) Field of Classification Search ..... 49/141, 49/360; 292/251.5, 201
See application file for complete search history.

(56) References Cited

U.S. PATENT DOCUMENTS

| | | | | |
|---|---|---|---|---|
| 3,464,159 | A | 9/1969 | Hewitt et al. | |
| 3,745,705 | A | 7/1973 | Reddy | |
| 3,834,081 | A | 9/1974 | Catlett | |
| 4,050,189 | A | 9/1977 | Peterson | |
| 4,063,388 | A | 12/1977 | Little | |
| 4,099,752 | A | 7/1978 | Geringer | |
| 4,198,786 | A | 4/1980 | Monot | |
| 4,257,631 | A | 3/1981 | Logan, Jr. | |
| 4,295,673 | A | 10/1981 | Miller | |
| 4,305,227 | A | 12/1981 | Georgelin | |
| 4,314,722 | A | 2/1982 | Logan, Jr. | |
| 4,324,425 | A | 4/1982 | Logan | |
| 4,328,985 | A | 5/1982 | Logan | |
| 4,351,552 | A | 9/1982 | VanDerLinden | |
| 4,354,699 | A | 10/1982 | Logan | |
| 4,470,625 | A | 9/1984 | Walsh et al. | |
| 4,487,439 | A | 12/1984 | McFadden | |
| 4,540,208 | A | 9/1985 | Logan, Jr. et al. | |
| 4,644,692 | A | 2/1987 | Schindehutte | |
| 4,652,028 | A | 3/1987 | Logan et al. | |
| 4,674,231 | A | 6/1987 | Radek et al. | |
| 4,703,962 | A | 11/1987 | Kelly et al. | |
| 4,720,128 | A | 1/1988 | Logan, Jr. et al. | |
| 4,796,931 | A | 1/1989 | Heid | |
| 4,826,223 | A | 5/1989 | Geringer et al. | |
| 4,839,988 | A * | 6/1989 | Betts et al. | 49/141 |
| 4,840,411 | A | 6/1989 | Sowersby | |
| 4,871,204 | A | 10/1989 | Cook et al. | |
| 4,882,876 | A | 11/1989 | Daugirdas | |

(Continued)

FOREIGN PATENT DOCUMENTS

EP 163942 A1 * 12/1985

(Continued)

*Primary Examiner* — Jerry Redman
(74) *Attorney, Agent, or Firm* — Pillsbury Winthrop Shaw Pittman LLP

(57) ABSTRACT

Systems and methods are described for controlling a break-away feature in a sliding door. The sliding door can be mounted in a doorway on a door hanger. The door is typically attached at one end using a hinge mechanism and maintained in planar alignment with the doorframe by a controllable mechanism such as an electromagnetic shear lock. An activation switch, such as a push-bar switch, initiates a delayed egress sequence that disengages the shear lock by controlling an energizing current in a magnet. When the shear lock is disengaged, the door can swing on the hinged mechanism. The delayed egress sequence can include one or more delays prior to disengaging the shear lock. Override signals can inhibit or force disengagement of the shear lock.

32 Claims, 12 Drawing Sheets

U.S. PATENT DOCUMENTS

| | | | | |
|---|---|---|---|---|
| 4,957,316 | A | 9/1990 | Frolov | |
| 4,981,312 | A | 1/1991 | Frolov | |
| 5,077,938 | A * | 1/1992 | Moreuil | 49/362 |
| 5,169,185 | A | 12/1992 | Slaybaugh et al. | |
| 5,429,399 | A | 7/1995 | Geringer et al. | |
| RE35,146 | E | 1/1996 | Frolov | |
| 5,605,362 | A | 2/1997 | Surko, Jr. | |
| 5,638,639 | A | 6/1997 | Goodman et al. | |
| 5,641,187 | A | 6/1997 | Frolov | |
| 5,758,913 | A | 6/1998 | Roth et al. | |
| 5,850,710 | A * | 12/1998 | Brock | 49/141 |
| 6,170,195 | B1 | 1/2001 | Lim | |
| 6,422,287 | B1 | 7/2002 | Wilke | |
| 6,490,832 | B1 * | 12/2002 | Fischbach et al. | 52/207 |
| 6,526,695 | B1 | 3/2003 | Nguyen | |
| 6,560,925 | B1 * | 5/2003 | Rice | 49/141 |
| 6,609,400 | B2 | 8/2003 | Luker | |
| 6,609,738 | B1 | 8/2003 | Roth et al. | |
| 6,758,504 | B2 | 7/2004 | Mandall | |
| 7,296,608 | B2 * | 11/2007 | Weishar et al. | 160/200 |
| 7,497,050 | B2 * | 3/2009 | Romero et al. | 49/141 |
| 2002/0053169 | A1 | 5/2002 | Menuzzo | |
| 2005/0104381 | A1 | 5/2005 | Whitaker et al. | |
| 2006/0150512 | A1 | 7/2006 | Heithe et al. | |

FOREIGN PATENT DOCUMENTS

| | | | |
|---|---|---|---|
| JP | 04279177 | A * | 10/1992 |

* cited by examiner

DELAYED EGRESS SLIDING DOOR AND METHOD

BACKGROUND OF THE INVENTION

1. Field of the Invention

The present invention relates generally to control of sliding doors and more particularly to controlling breakaway features of sliding systems wherein the breakaway systems can be selectively locked and/or unlocked.

2. Description of Related Art

Sliding doors are installed in many environments, and particularly in commercial buildings where sliding doors are configured to automatically open and close in order to provide easy access to premises and avoid congestion in high traffic environments. In certain circumstances, sliding doors include a breakaway feature that permits the door to be pivotally swung open about a hinge in order to maximize a doorway opening. The breakaway feature is generally provided to permit rapid egress from a building and, in some cases, to improve access to the building for bulky objects, and it prevents the door from automatically sliding back to the closed position.

In many instances, however, it may be desirable to limit the use of breakaway features. In one example, such desire may derive from a desire to reduce or deter theft of goods through such doors.

BRIEF SUMMARY OF THE INVENTION

Aspects of the invention resolve many of the issues associated with versatile egress systems associated with sliding doors. In certain embodiments, automated conversion of the configuration of doorways from a sliding door to a swinging door opening can be accomplished while preserving the security of the doors. In certain embodiments, a delayed egress system permits conversion of sliding door operation after a programmed time has elapsed. Notifications, alarms and indicators can be provided to permit supervision of the procedure. In certain embodiments, remote monitoring systems can be used to override the conversion procedure, and in some embodiments a reset switch is provided to allow a person operating the delay egress system to abort the procedure.

In one embodiment there is provided a sliding door system comprising a door assembly constructed and arranged to be mounted in a door frame, the door assembly including a door panel and a drive system, the drive system operatively connected with the door panel to effect linear movement of the door panel within the door frame between open and closed linear positions, the door panel being mounted for pivotal movement between a normally closed pivotal position, and an open pivotal position; a door lock that normally retains the door panel in the closed pivotal position, a door release operatively associated with the door, the door release being operable to enable movement of the door panel from the closed pivotal position to the open pivotal position; and a controller operatively connected with the door release so as to receive a signal indicating that the door release has been actuated, the controller generating a door release signal to unlock the door lock to enable movement of the door panel from the closed pivotal position to the open pivotal position after a period of time subsequent to operation of the door release.

In another embodiment there is provided a sliding door system comprising a door assembly constructed and arranged to be mounted in a door frame, the door assembly including a door panel and a drive system, the drive system operatively connected with the door panel to effect linear movement of the door panel within the door frame between open and closed linear positions, the door panel being mounted for pivotal movement between a normally closed pivotal position, and an open pivotal position; a releasable door lock that normally retains the door panel in the closed pivotal position; a controller operatively connected with the door lock; and the controller selectively operable to lock or unlock the door lock to prevent or enable pivotal movement of the door panel.

Additional embodiments and features are also provided, as set forth in the following detailed description, claims, and drawings.

BRIEF DESCRIPTION OF THE DRAWINGS

These and other features, aspects and advantages of the present invention will be more fully understood when considered with respect to the following detailed description, appended claims and accompanying drawings wherein:

DETAILED DESCRIPTION OF THE INVENTION

Figure 1A:
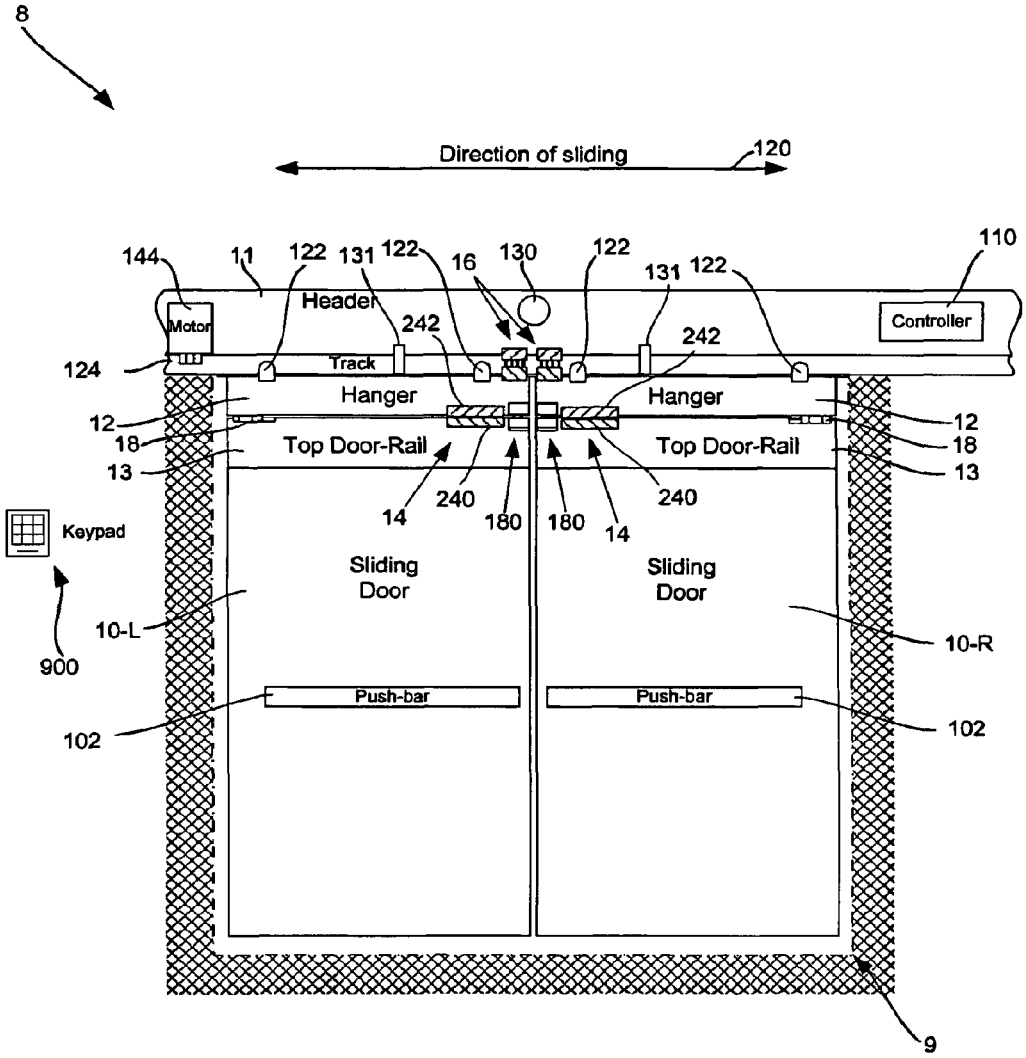
FIGS. 1A, 1B and 1C illustrate an example of an embodiment of a delayed egress system.

Embodiments of the present invention will now be described in detail with reference to the drawings, which are provided as illustrative examples so as to enable those skilled in the art to practice the invention. Notably, the figures and examples below are not meant to limit the scope of the present invention. In the drawings, like components, services, applications, and steps are designated by like reference numerals throughout the various figures. Where certain elements of these embodiments can be partially or fully implemented using known components, only those portions of such known components that are necessary for an understanding of the present invention will be described, and detailed descriptions of other portions of such known components will be omitted so as not to obscure the invention. Further, the present invention encompasses present and future known equivalents to the components referred to herein by way of illustration.

Certain embodiments of the invention provide delayed egress systems that permit sliding door panels to swing open under certain predetermined conditions. Referring to the example illustrated in FIGS. 1A, 1B and 1C, a sliding door system 8 includes sliding door panels 10-L and 10-R, each mounted in a door frame 11 using respective hangers 12. Hangers 12 can be mounted in the door frame header 11 on rollers, bearings wheels or other mechanisms 122 known in the art that permit the hangers to slide generally linearly along a track or rail 124 as indicated by arrows 120 where the track or rail 124 is fixed to the door frame header 11. In FIG. 1A, door panels 10-L and 10-R are illustrated in a closed configuration. Specifically, the door panels 10-L and 10-R are shown occupying a door opening 9. In normal operation of door panels 10-L and 10-R, when a sensor 130 detects an individual approaching the doorway, a door opening signal will be generated and input to a controller 110, which in turn will generate a signal to slide door panel 10-L leftward and door panel 10-R rightward (when oriented as in FIG. 1B) such that the door panels 10-L and 10-R are moved from the door opening 9 to an open configuration (see FIG. 1B), thereby permitting egress through the door opening. After a predetermined period of time, the controller 110 will generate a door closing signal to return the door panels 10-L and 10-R to the closed position of FIG. 1A. The aforementioned sensor 130 for sensing the presence of an individual may optionally be of the type disclosed in U.S. Pat. No. 7,042,492 ("the '492 patent") to Spinelli, entitled "Automatic Door Assembly with Video Imaging Device," which is hereby incorporated by reference in its entirety. The controller 110 can also include the sliding door control functionality disclosed in the '492 patent to control opening and closing sliding movement of the door panels.

In normal operation, door panels 10-L and 10-R and their respective hangers 12 are maintained in planar alignment with the doorway, as illustrated in FIG. 1A. Hangers 12 can be linearly driven along the track or rail 24 on door frame header 11 by a drive system such as an electromagnetic, pneumatic, hydraulic or any other suitable motor or other type of drive system 144. In one embodiment, the drive system may comprise a motor 144 mounted in or on the door frame header 11 (see FIGS. 1A and 1B) such that the motor 144 cooperates with a cable, belt, chain, screw-drive or other such mechanism to slide doors 10-L and 10-R along the track 124 in the direction of sliding 120. In another embodiment, the drive system may comprise a motor 244 mounted in or on a door hanger 12 of a door panel 210 (see FIG. 2) rather than the header 11 such that each hanger-mounted motor 244 cooperates with a suitable transfer mechanism to cause an individual door 210 to slide along the track 124 in the direction of sliding 120. In one embodiment, each door 210 is provided with a roller, bearings, or some other structure for riding along track 124. In one embodiment, hanger-mounted motor 244 may be provided in addition to header-mounted motor 144 and, in some embodiments, may perform a function different from that of header-mounted motor 144. For example, hanger mounted motor 244 may be configured to provide power-assisted rotated opening of door panel 210 while header-mounted motor 144 may drive sliding opening of door panel 210.

Figure 1B:
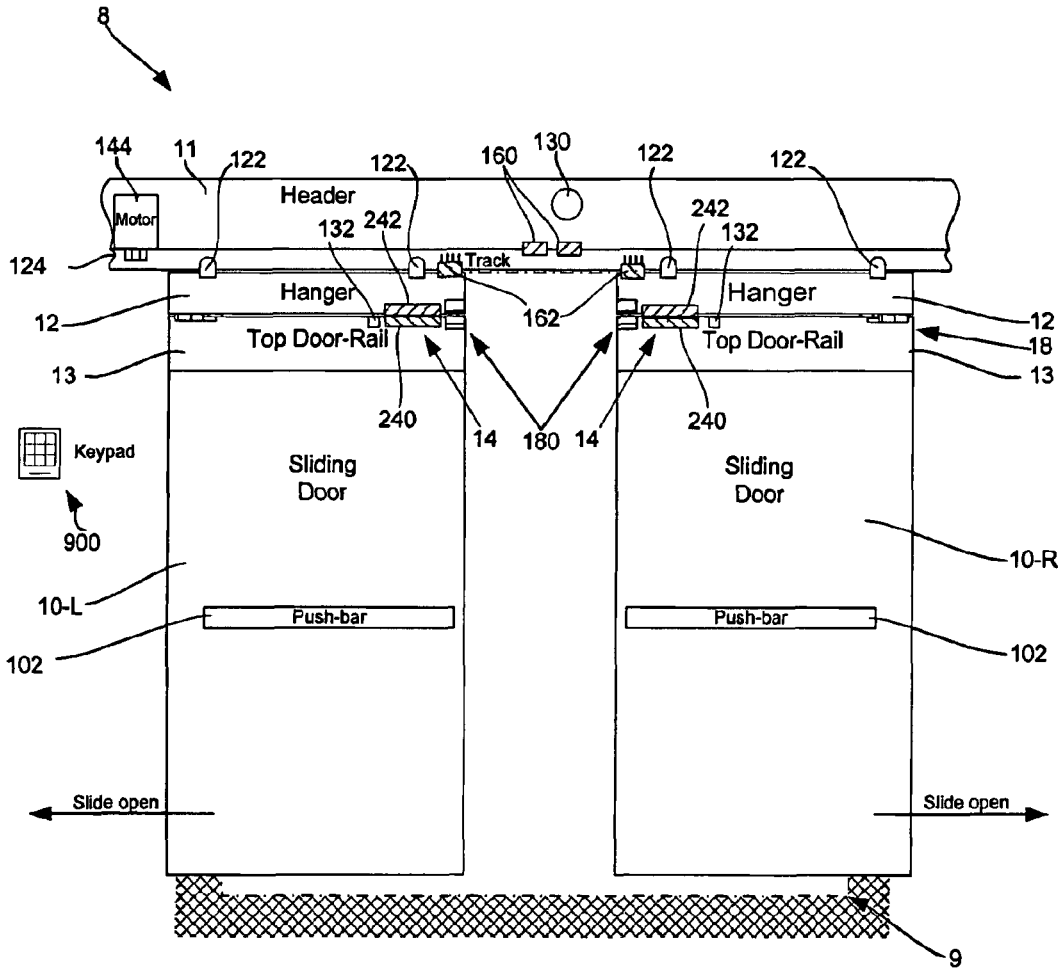
Figure 1C:
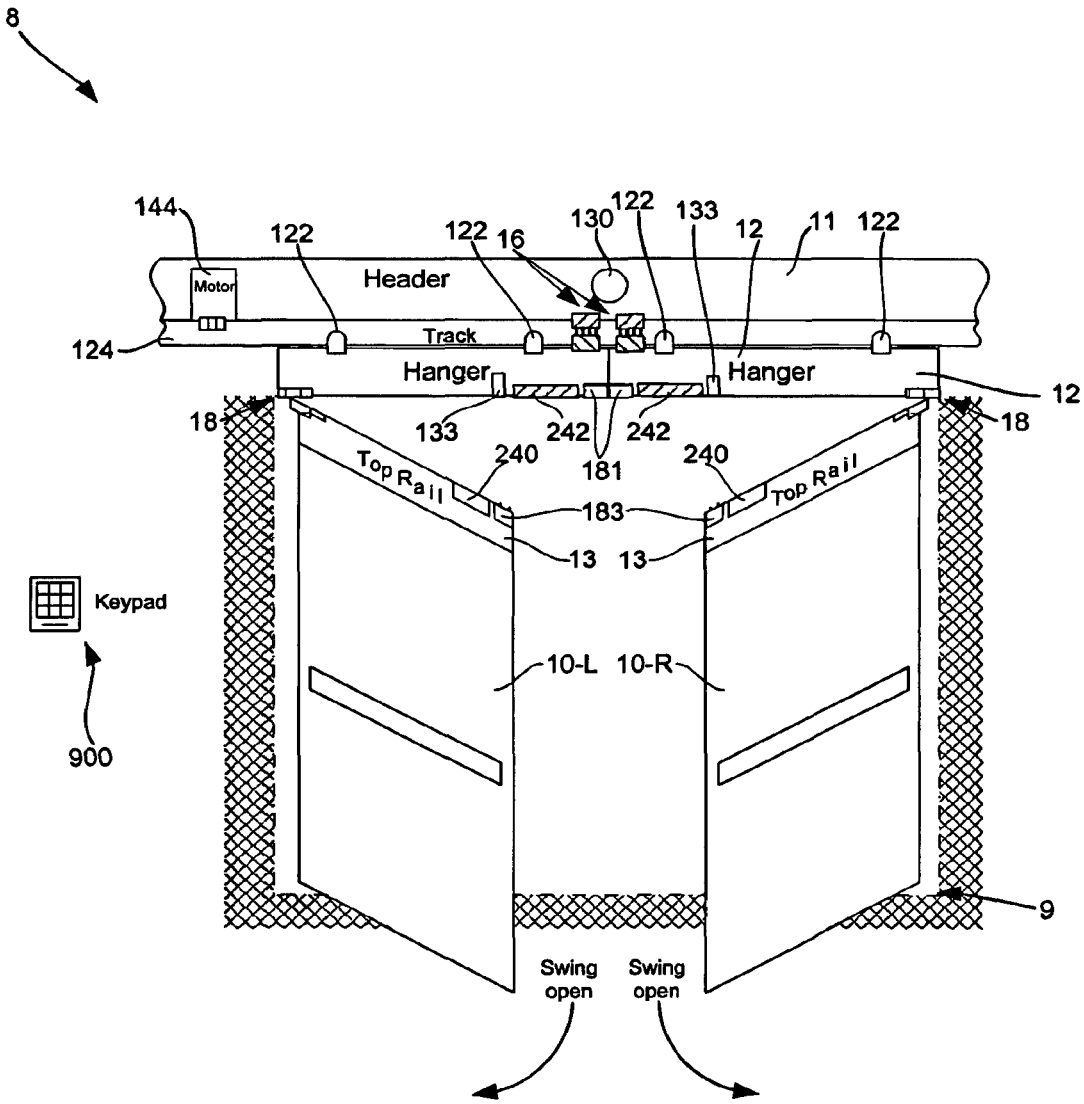

As shown in FIG. 1C, the doorway can be reconfigured by permitting the normally sliding door panels 10-L and 10-R to operate as swinging doors, whereby door panels 10-L and 10-R can rotate about respective vertical axes on respective hinge mechanisms 18 that are typically provided at one end of door panels 10-L and 10-R. In one embodiment, hinge mechanisms pivotally connect an upper frame or rail member 13 of the panels 10-L and 10-R to the associated door hanger 12. In another embodiment, hinge mechanisms pivotally connect a door hanger 12 of each of the panels 10-L and 10-R to the track 124 or to the header 11. Door panels 10-L and 10-R may be swung open to facilitate access through the door opening during emergency, power failure, and other situations generating high volume traffic through door panels 10-L and 10-R such as at the beginning or end of an event. The reconfigured doorway may also be pivotally open to facilitate passage of bulky items through the doorway.

Reconfiguration of a doorway is typically accomplished using breakaway feature or lock(s) 14 that ordinarily locks one or both door panels 10-L and 10-R in a pivotally closed position. For example, in one embodiment, the door panels 10-L and 10-R are normally pivotally locked against respective door hangers 12, thereby maintaining door panels 10-L and 10-R and corresponding hangers 12 in a common vertical plane (as shown in FIG. 1A). In certain embodiments, locks 14 operate as interlocks that, when activated, maintain door panels 10-L and 10-R in planar alignment with the door frame 11 (and hangers 12) by preventing rotation of door panels 10-L and 10-R about their hinge mechanisms 18. According to certain aspects of the invention, locks 14 are controlled electronically and can comprise any suitable locking systems including, for example, electromagnetic shear locks, electromagnetically operated bolts and pneumatically or hydraulically operated locking system, for example.

Figure 3:
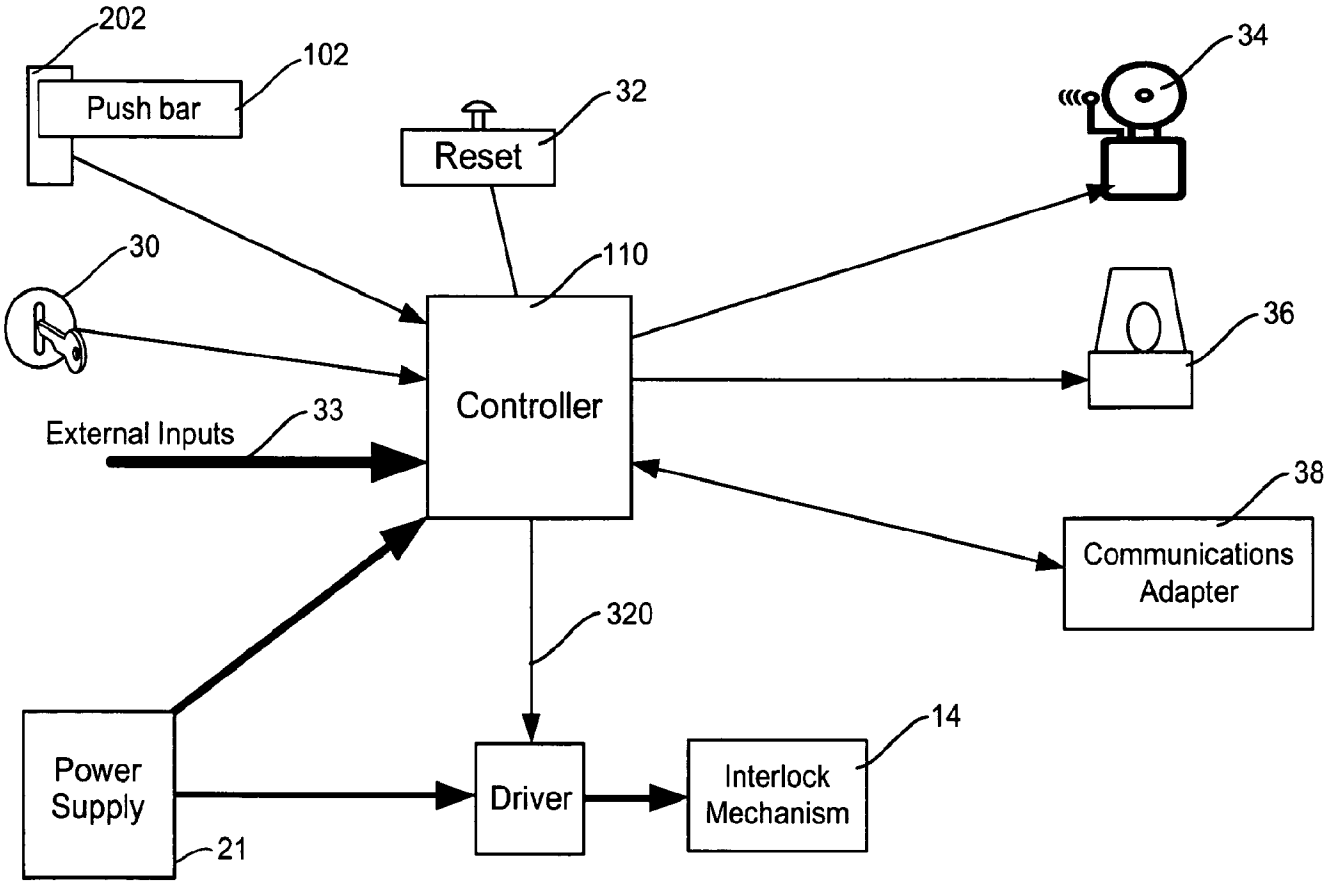
FIG. 3 provides a block diagram representing various functional elements in an embodiment of the invention.

In certain embodiments, electrical connections can be made between frame 11 and hanger 12 using an electrical signal transfer system 16. Transfer system 16 typically provides power sufficient to operate lock(s) 14. In some embodiments, the presence or absence of power provided by transfer system 16 is sufficient to enable and disable the lock(s) 14, respectively. The quantity and location of transfer systems 16 used in a doorway can be selected based on the amount of power required, the number of control signals and the desired operational characteristics of the doorway. In some embodiments, control signals are also passed between frame 11 and hanger 12 using transfer system 16, wherein the control signals operate to enable and disable lock(s) 14. In certain embodiments control signals passed between door frame 11 and hanger 12 include signals generated by switches and indicators used in controlling operation of lock(s) 14. For example, an override signal can be provided to inhibit or force activation or deactivation of lock(s) 14; the override signal may be controlled by a fire alarm or other signal that is sent to the controller 110 to be described and as seen in FIG. 3. Operation of the override signal is typically determined based on the source of the signal. For example, a fire detection system may provide an override signal to force unlocking of lock(s) 14 while a security system may provide a different override signal to prevent unlocking of lock(s) 14 irrespective of any actuation of a door opening mechanism (such as a push-bar) as will be described.

In certain embodiments, control signals may be generated within the door panel 210, top door-rail 13 or hanger 12, whereby the state of these control signals influence operation of lock(s) 14. For example, a door release mechanism such as a push bar 102 can be provided on sliding door panel 210 that, when pushed, closes or opens a switch, or otherwise sends a signal to controller 110, thereby indicating a request to disengage or unlock the lock(s) 14 so that sliding door panel 210 may be pivoted open. In one example, a push bar 102 may contain a micro-switch assembly that is actuated when an individual forces the push bar 102 inwardly a predetermined distance against an internal spring that biases the push bar 102 outwardly. In certain embodiments, door panel 210 may include a key lock or keypad 900 that can be used to lock and unlock door panel 210 and to enable and disable breakaway feature 14. In another embodiment, a sensor or switch 131, 132, 133 (see FIGS. 1A, 1B and 1C) mounted on, for example top door-rail 13, hanger 12 or header 11 detects that the door panel 210 itself has been pushed, which will generate a door opening signal to controller 110. In certain embodiments, sensors 131, 132 and 132 may detect that the door has been pushed and may generate a signal to the controller 110 to prevent the door, typically by disabling power to a door driver such as motor 144. Sensors or switches 131, 132, 133 may detect displacement of the door panel 210 relative to the header or may detect application of a pivotal opening force. In some embodiments, application of pivotal opening forces may be detected by any other known means including strain gauges, changes in electrical current applied to an electromagnetic shear lock, and so on.

Figure 2:
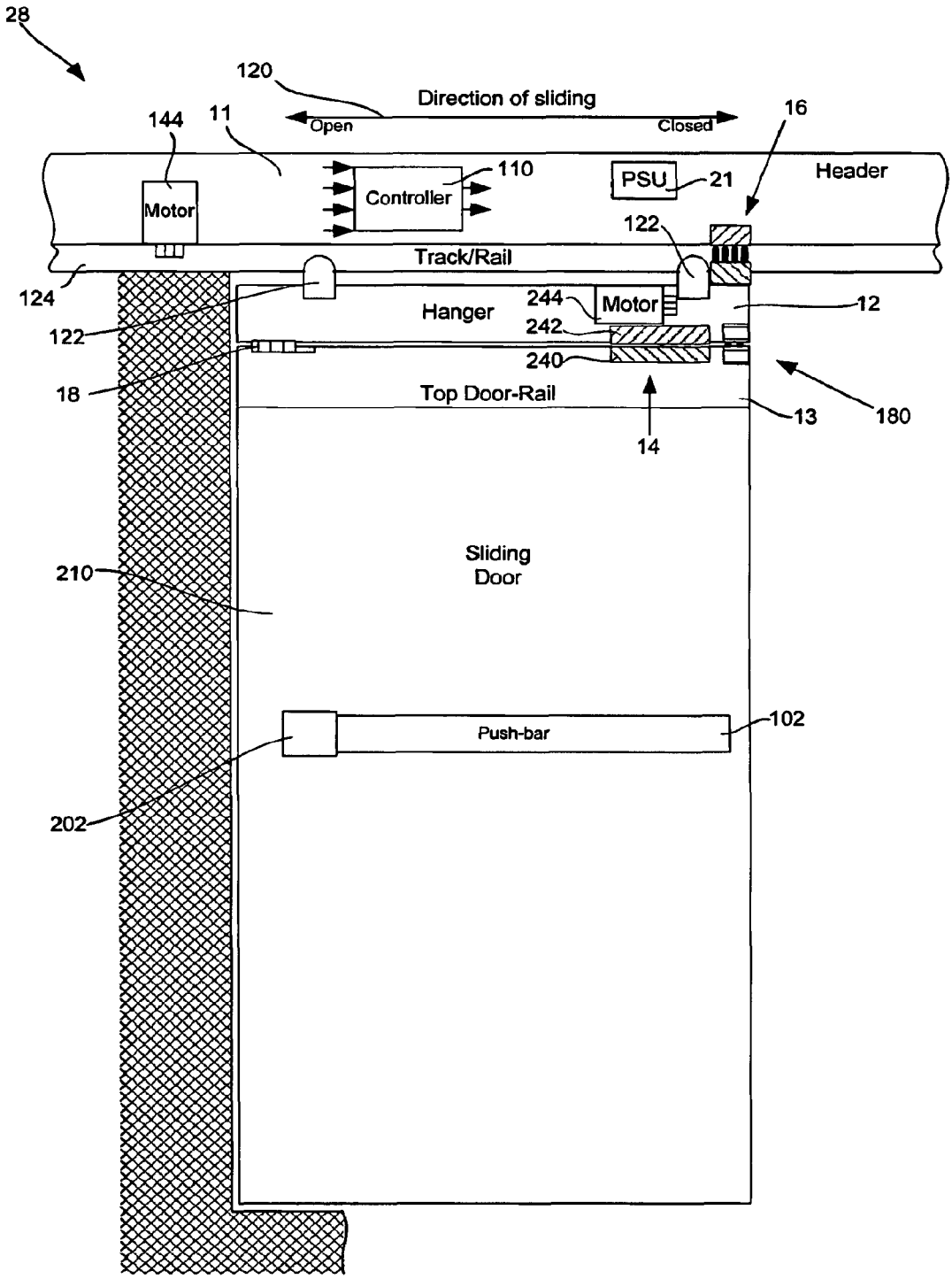
FIG. 2 depicts a door assembly according to certain aspects of the invention.

In certain embodiments, the lock(s) 14 can comprise an electromagnetic shear lock. A shear lock is an electromechanical magnetic locking device that generates a magnetic field between magnet and armature when an energizing current is provided to the magnet 242. FIG. 2 depicts an example of a delayed egress system in which breakaway feature (lock) 14 comprises a shear lock having an armature component 240 and a magnet component 242 for securing door panel 210 to door hanger assembly 12. Armature 240 can be mounted in a recess or on a surface of hanger 12 and magnet 242 can be mounted in a recess or on a surface of top door-rail 13. Alternately, the armature 240 can be mounted on the top door-rail 13 and the magnet 242 would then be mounted on the hanger. When magnet 242 is energized, a strong magnetic attraction is developed between armature 240 and magnet 242 requiring shear forces sufficient to resist efforts to separate armature 240 and magnet 242 by physical force. It will be appreciated that operation of the electromagnetic shear lock typically requires that armature 240 and magnet 242 be proximately located and aligned to maximize magnetic flux in a gap between armature 240 and magnet 242 when magnet 242 is energized.

Energizing current can be provided to the magnet 242, if provided on the top door-rail 13, by the controller 110 through a second contact assembly 180. The second contact assembly 180 may provide at least two connections to permit current to flow into and out from top door-rail 13. However, in some embodiments, additional contacts may be provided to carry signals and power between top door-rail 13 and door hanger 12. Electrical signals and power can also be communicated between top door-rail 13 to the door frame 11 through the first contact assembly 16. First contact assembly 16 can be configured to transmit signals and power between door frame header 11 and controller 110 embedded in door hanger 12. It will be appreciated that the mounting positions of magnet 242 and armature 240 could easily be reversed such that magnet 242 would be mounted in or on hanger 12 and armature 240 would be mounted in or on top door-rail 13. Likewise, the quantity and location of first contact assemblies 16 and second contact assemblies 180 used in a doorway can be selected based on the amount of power required, location and configuration of doorway components, the number of control signals and the desired operational characteristics of the doorway.

In certain embodiments, second contact assembly 180 may be configured and located in relation to the hinge assembly 18 such that contacts are maintained between selected electrical circuits in hanger 12 and top door-rail 13 regardless of door configuration. However, in some embodiments the second contact assembly 180 is configured and arranged to interrupt energizing current flow to the magnet 242 mounted in top door-rail 13 when the door is pivotally opened. More specifically, second contact assembly 180 can be positioned and configured such that when the door panel 210 is rotated open around hinge 18 (as shown, for example, in FIG. 1C), the electrical circuit coupling magnet 242 and controller 110 is broken and, consequently, the magnet cannot be re-energized until the door panel 210 is restored to normally closed position.

In certain embodiments, a controller 110 monitors control signals and selectively enables and disables lock(s) 14. Controller 110 may be located in the door panel 210, in the door hanger 12, in the door frame header 11, adjacent to the door frame header 11 or in a location remote from the door panel 210. A power supply 21 can be collocated with controller 110 within the door assembly 28. For example, power supply 21 can be mounted in the door frame header assembly 11 and may be configured to provide power at 24 VDC to energize a shear lock and to supply controller 110, which is also located in the door frame header 11. Controller 110 typically controls power provided to magnet 242 and may also process one or more signals to determine operational state of lock(s) 14. In one example, controller 110 comprises a processor, storage, input/output devices and executes software and/or firmware configured to monitor control signals. Control signals may be provided by sensors, switches, actuators and other externally provided controls. Controller 110 may determine when the lock(s) 14 should be engaged or disengaged based on the state of monitored control signals. To cause the lock(s) 14 to be in a locked condition, the controller 110 may cause a magnet current to flow through magnet 242. In one embodiment, controller 110 may select one of a plurality of current settings to obtain a desired shear force required to open door panel 210 as a swinging door panel.

Software executed by controller 110 may include a real-time operating system, tables or databases for maintaining configuration information and application software configurable to monitor switch settings and other control information. In some embodiments, controller 110 may be provided as configurable sequencing logic or combinations of processors with embedded software that monitor changes in switch settings and control and configuration information and that can cause sequencing logic to initiate or terminate sequences of signals and currents in order to enable and disable lock(s) 14.

In certain embodiments, upon determining that lock(s) 14 should be deactivated, such as by result of an individual pushing on the push-bar 102, thereby activating a switch that sends a signal to controller 110, the controller 110 may disable current through magnet 242 (perhaps only after a delay as will be described) for a predetermined period of time sufficient to allow the door panel 210 to be swung open. However, if the door panel remains in its normal operating configuration (e.g., FIGS. 1A and 1B), magnet 242 may be re-energized after the predetermined period of time has elapsed, thereby locking door panel 210 in its normal, slidable configuration. In some embodiments, after the door panel 210 has been rotatably opened, the lock(s) 14 may be gradually reenergized in a manner that provides dampening of any oscillation of the door panel 210 about the hinge 18.

In certain embodiments, a first contact assembly 16 may be configured to maintain selected electrical circuit connections between door frame header 11 and hanger 12 regardless of door configuration (e.g. FIGS. 1A, 1B and 1C). Circuits that may require continuous connection can include circuits providing excitation current from controller 110 to magnet 242. Other circuits may be connected only when the door panel 210 is positioned in a predetermined configuration, including slidably closed, slidably open, rotatably open and certain combinations of open and closed modes. For example, electrical connection between door frame header 11 and hanger 12 may be provided using contact pads located continuously and/or at predetermined points along rail 124, through mountings 122 used for coupling hanger 12 to track or rail 124, through a wiring harness or through any other suitable means.

In certain embodiments, the controller can determine sliding door system 8 status and current configuration by monitoring electrical connections between door frame header 11 and hanger 12 and between hanger 12 and door-rail 13. Based on determined status and configuration, the controller 110 may activate and deactivate lock(s) 14 and may transmit alarms and monitoring signals to a centralized control system. In one example, after the door panel 210 has been rotatably opened (e.g., FIG. 1C), the controller 110 may reactivate the lock(s) 14 upon detecting that the door panel 210 has been returned to its normal operating configuration (e.g., FIGS. 1A and 1B). In the latter example, an alarm notification can be generated if the door panel 210 remains rotatably opened beyond a predetermined maximum time.

FIG. 3 provides a simplified block diagram showing certain components found in an example of a delayed egress system in accordance with one embodiment. Controller 110 can monitor the state of a plurality of inputs including switches 202, 30 and 32. In the example, switch 202 can be activated by operating the push bar 102 that is typically located in a middle section of door panel 210. Push bar 102 can be provided as a low profile push bar and may be extending outwardly from or recessed within door panel 210. Push bar 102 may be used to initiate disengagement of lock(s) 14 of door panel 210 so that door panel 210 can be swung open. In one example, switch 30 may be provided as a key operated override switch which can be used by an operator, emergency responder or other authorized person to instantaneously enable or disable lock(s) 14 of door panel 210 without regard to any other input to the controller 110. For example, switch 30 may be configured to disable the switch 202 of the push bar 102 so that the lock(s) 14 will not be unlocked even if the push bar 102 is pushed.

In one embodiment, a reset key switch 32 can be provided that disables a buzzer 34 or other audible alarm associated with the delayed egress system and to restart delayed egress functions. Controller 110 can be configured to enable or disable lock(s) 14 in response to one or more external signals 33 provided by external control or monitoring systems. External control or monitoring systems can include fire alarm systems, security systems, master control systems and the external signals 33 can cause lock(s) 14 to be engaged or disengaged based on system configuration and doorway type, function or location.

Controller 110 can generate control signals 320 that control (enable or disable) a current provided to actuator 242. Controller 110 may also communicate activity associated with the delayed egress system. For example, controller may drive an audible alarm 34 such as a piezoelectric buzzer and/or visual indicators such as a strobe light, or display a message on a text or graphics display 36. Such audible and/or visual signals may be provided to indicate activation of push bar 102 and imminent deactivation of lock(s) 14. For example controller 110 may sound an alarm after receiving a breakaway door opening signal (such as from switch 202), and prior to, during and after unlocking of lock(s) 14. Audible alarm 34 is typically mounted in proximity to the door system 8. In certain embodiments, controller 110 may communicate with a remote monitoring system prior to, during and after disengagement of lock(s) 14 using communications adapter 38.

Figure 4:
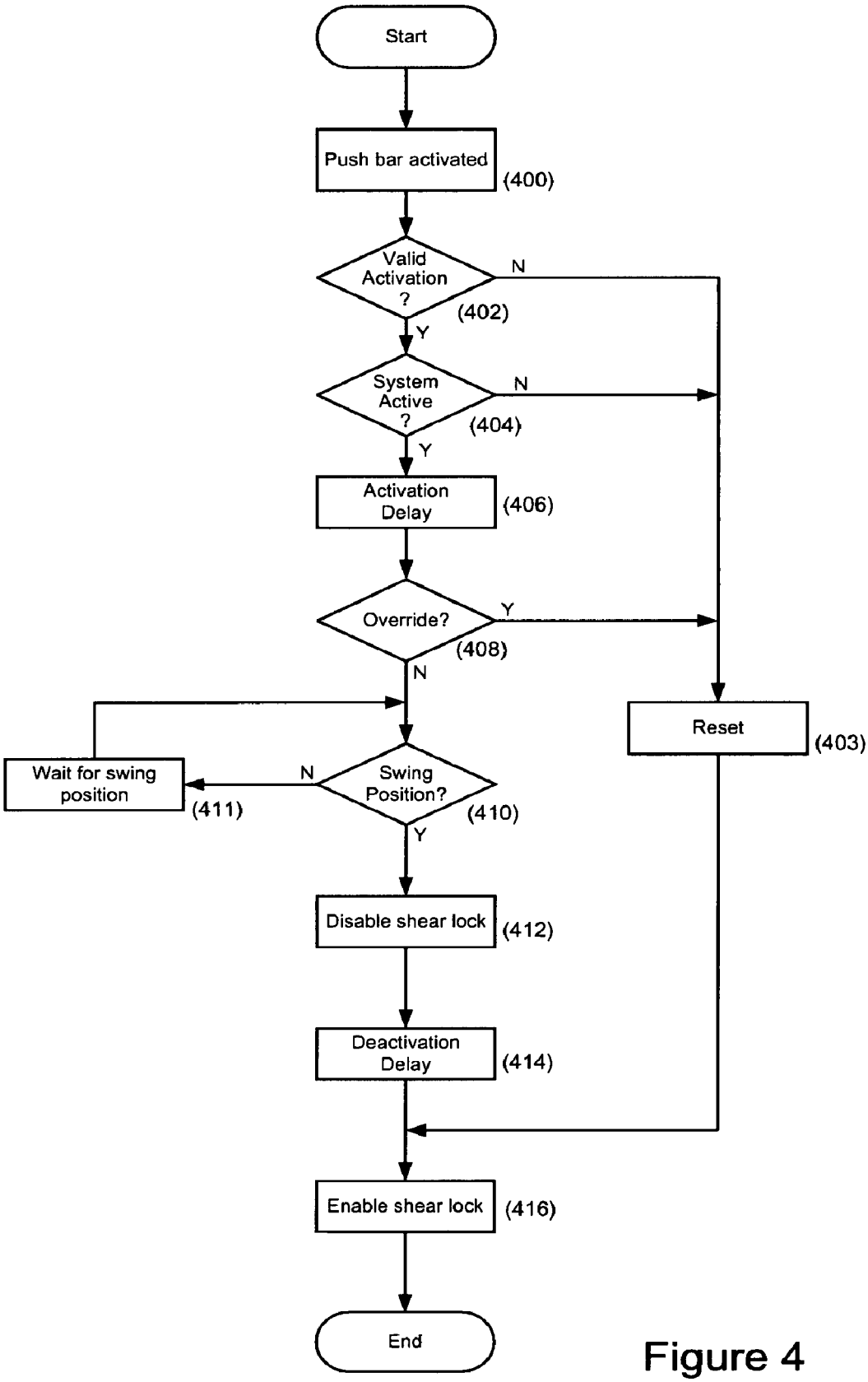
FIG. 4 provides a flowchart illustrating a simplified example of operation of a delayed egress system according to aspects of the current invention.

Operation of one example of the door system 8 is described in the simplified flow chart of FIG. 4, with reference to FIGS. 1A, 1B and 2. In normal operation the door system 8 provides a sliding door panel 210 that moves in a direction 120 generally parallel to a wall in which the system is mounted. However, door panel 210 may be swung open as shown in FIG. 1B in response to activation of an egress switch. At step 400 in the example, the egress switch 202 is activated by an individual pushing on push bar 102 thereby generating an egress signal. The egress signal is monitored by controller 110 and, upon detecting assertion of the egress signal indicative of the push bar 102 having been pushed, controller 110 may determine at step 402 if a delayed egress sequence should be initiated. Such determination may be based on duration of push bar activation. For example, controller 110 may determine that the delayed egress sequence should be initiated after the push bar is pushed for a predetermined minimum activation time calculated to reduce the possibility that the activation of the push bar 102 resulted from accidental, incidental or unintentional contact. In one example, the predetermined activation time may be set between 0.5 and 2.5 seconds. If activation of the push bar is determined to be unintentional, then the egress signal may be ignored and system status may be reset at step 403.

If it is determined that activation of push bar 102 was intentional, the delayed egress sequence may commence with a programmed delay period at step 406. The length of programmed delay period 406 is typically measured in seconds: in one example, a fifteen second delay is provided as a default value for delay period 406. In another example, a thirty second delay is used for the default period. While awaiting the completion of the programmed delay period 406, the controller 110 may issue one or more alerts indicating that the lock(s) 14 of door panel 210 will be released (after the delay period). The alert can be provided as audible signals, visual indications including flashing lights, and as combinations of audible and visual signals. In certain embodiments, controller 110 can send information to a security system, or centralized computer that monitors numerous door systems 8, identifying door panel 210 and indicating that a request for delayed egress has been received.

In one embodiment, the controller 110 can be set manually or electronically so that, if desired, the delay can be optionally disabled so that no delay (zero seconds) exists to operate the breakaway feature as in a conventional mode.

In certain embodiments, if door panel 210 is not in a fully closed position when the door release switch is activated, door panel 210 is returned to its normal closed position during delay period of step 406 such that sufficient clearance is available to swing door panel 210. Door panel 210 may be returned to its closed position by disabling any cameras, motion detectors or other sensors that would otherwise cause the door panel to open or remain open. In certain embodiments, the controller 110 may instruct the drive system 144 or 244 to return door panel 210 back to its closed position.

In the programmed delay period 406, controller 110 may monitor system override inputs to determine if the delayed egress sequence is to be aborted. Thus, for example, a person having activated push bar 102 at step 400 may choose to abort the operation by activating a "STOP" switch provided in proximity to door panel 210. Similarly, a remote monitor or switch may send an override signal instructing controller 110 to abort the delayed egress sequence. Override signals can also be generated based on programmed time of day and day of year information that specifies when the delayed egress sequence may be activated. Overrides may cause programmed delay 406 to be terminated early and, upon detecting an override at step 408, the process may be terminated, typically by resetting the system at step 403.

In one embodiment, the breakaway override feature can be implemented to disable the breakaway feature of the door in a system that does not have a delayed egress system. In other words, in some systems it may be desirable to selectively disable the breakaway feature so that lock(s) 14 remains enabled even when the lock release (e.g., push bar 102) is pushed so that the door remains pivotally locked. Thus, the override feature is independent of the delayed egress feature, and vice versa. Either can be implemented without the other.

After completion of the programmed delay in step 406, if no override is detected at step 408, interlock disable may be initiated. In certain embodiments, step 410 checks to ensure that the door panel 210 is configured for breakaway and may wait at step 411 for such configuration. In some embodiments, breakaway is only enabled when the door panel 210 is in a rest or closed position as shown in FIG. 1A. However, in some embodiments, the door panel 210 can be swung from any position.

At step 412, the controller may deactivate lock(s) 14 by enabling an energizing current for magnet 242 of a shear lock. In certain embodiments, interlock may be reactivated at step 416 after a programmed deactivation delay at step 414. Deactivation delay 414 is typically selected to allow sufficient time for door panel 210 to be swung open. Upon return to its normal closed position after deactivation delay 414 has expired, breakaway feature 14 can operate to lock door panel 210 into its normal operating configuration and sliding operation can be resumed.

Figure 9:
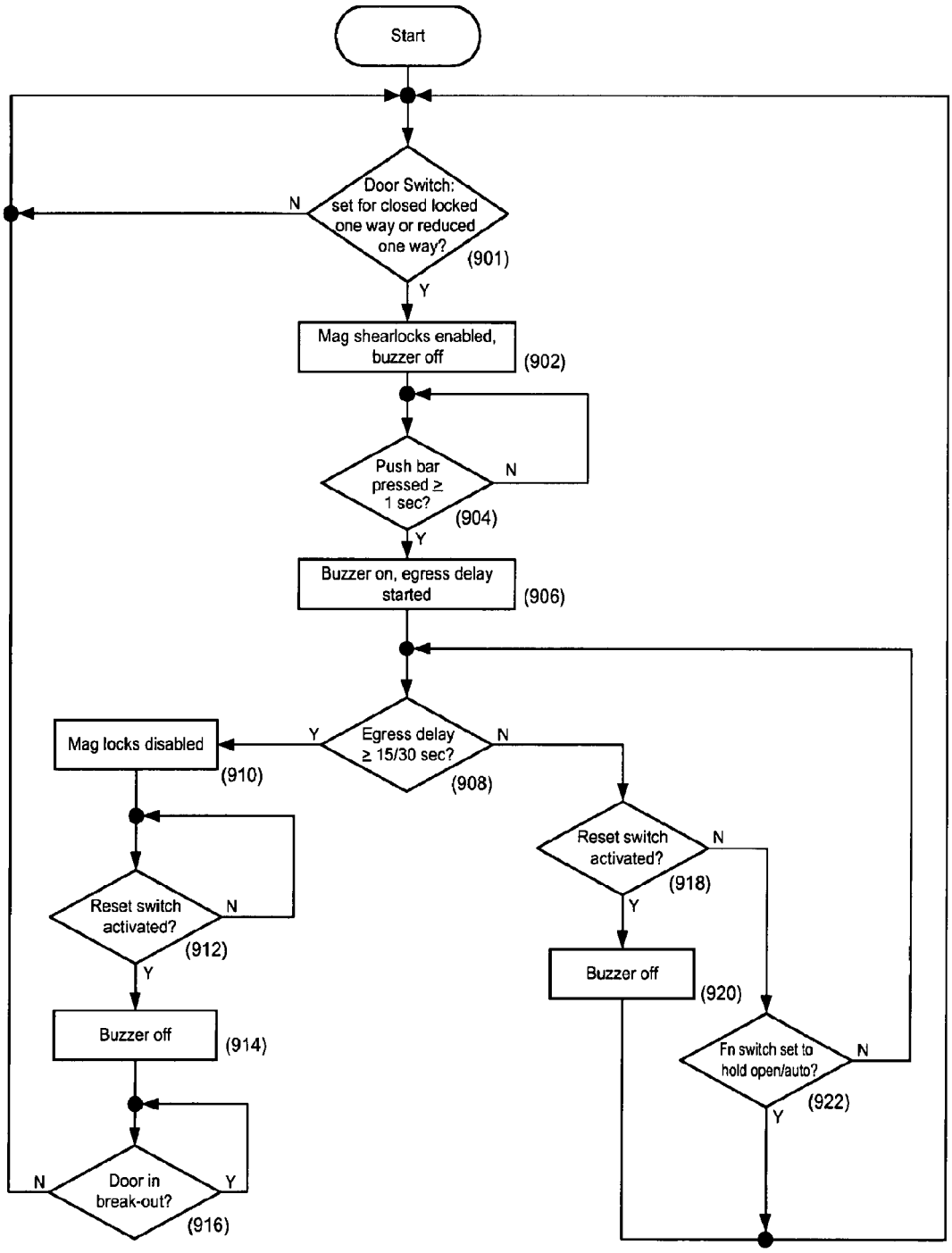
FIG. 9 provides a flowchart illustrating operation of a delayed egress system according to aspects of the current invention.

Another example illustrating operation of a door system 8 according to certain aspects of the invention is described in the flow chart of FIG. 9, with reference to FIGS. 1A, 1B and 2. In normal operation the door system 8 provides a sliding door panel 210 that moves in a direction 120 generally parallel to a wall in which the system is mounted. However, door panel 210 may be swung open as shown in FIG. 1B in response to activation of an egress switch. At step 901, upon initialization, the state of a door switch may be checked to determine allowable modes of operation of the door system 8. The door switch can be provided as an integral part of keypad 900 or may be provided separately. In some embodiments, the door switch function can be provided through control software responsive to commands provided from a control console and/or keypad 900. If the door switch is set such that delayed egress mode is enabled, then at step 902 magnetic shear lock(s) 14 is enabled and a buzzer 34 is disabled. At step 904, an egress switch 202 can be monitored to detect activation caused by an individual pushing on push bar 102 thereby generating an egress signal. The egress signal is typically monitored by controller 110 and, upon detecting assertion of the egress signal indicative of the push bar 102 having been pushed, controller 110 may begin a push bar delay. The push bar delay may be implemented using a delay timer that can be provided as a combination of electronic and software timers. The push bar delay timer is typically reset if the push bar 102 is not pushed for a minimum period of time; in the example the minimum time is one second, but the minimum time can be selected as desired to be two or more seconds. In one example, the predetermined activation time may be set between 0.5 and 2.5 seconds. Typically the minimum time is selected to be less than 15 seconds.

If the push bar 102 is pushed for at least the selected minimum time, an egress delay timer can be started and the buzzer 34 may be enabled at step 906. The length of egress delay measured at step 908 is typically measured in seconds: in one example, a fifteen second delay is provided as a default value for the egress delay period. In another example, a thirty second delay is used for the default period. The egress delay may be measured using any suitable electronic timer including a combination of dedicated timer and software. While awaiting the completion of the egress delay period at step 908, the controller 110 may issue one or more alerts indicating that the lock(s) 14 of door panel 210 will be released (after the delay period). The alert can be provided as audible signals, visual indications including flashing lights, and as combinations of audible and visual signals. In certain embodiments, controller 110 can send information to a security system, or centralized computer that monitors numerous door systems 8, identifying door panel 210 and indicating that a request for delayed egress has been received.

In the discussion above, the timer and/or timers may be integrated into the controller 110. In another embodiment, a separate timer or clock may be used in combination with (operatively connected to) the controller 110.

While monitoring the egress delay period at step 908, controller 110 may also monitor system override inputs at steps 918 and 922 to determine if the delayed egress sequence is to be aborted. Thus, for example, a person having activated push bar 102 at step 904 may choose to abort the operation by activating a "RESET" switch provided in proximity to door panel 210, causing the buzzer to be disabled at step 914 and the egress sequence to abort. Similarly, a remote monitor or switch may send an override signal instructing controller 110 to abort the delayed egress sequence. Override signals can also be generated based on programmed time of day and day of year information that specifies when the delayed egress sequence may be activated. In certain embodiments, if door panel 210 is detected to be in an open position at step 922, the delayed egress sequence may be optionally aborted.

After completion of the programmed delay in step 908, and if no reset request or override has been detected at steps 918 and 922, interlock disable may be initiated at step 910. In certain embodiments the magnetic lock(s) 14 remain disabled until a door reset condition is detected at step 912. Door reset conditions may include an indication that the door panel 210 has returned to its normal operating configuration, that a reset signal has been received from keypad 900 or from a central controller, and that a signal from a timer initiated when egress is enabled. Upon detecting a door reset condition, the buzzer 34 may be disabled at step 914. In certain embodiments, the process ends when the door panel 210 is determined at step 916 to be in normal operating configuration after which determination, the system can be reset, including enabling the magnetic lock(s) 14 (at step 902, for example).

Regarding the operation of overrides, various methods can be employed to communicate signals to controller 110. In certain embodiments, switches of various kinds can be used, including push-button switches, key-activated switches, motion detector switches, RFID readers, keypads, and so on. In certain embodiments, controller 110 may be adapted to communicate with a remote control center. Controller 110 may be adapted by providing controller 110 with a communications interface 38 for accessing wired and wireless communications interfaces including interfaces for serial data links (including modems), wired and wireless Ethernet networks, WiFi, InfraRed, Bluetooth and cellular telephone networks.

In one embodiment, when the detector or sensor 130 for detecting an individual approaching the doorway is disabled by the controller 110 to prevent the door panel 210 from sliding to its open position, the drive system or motor is configured so that it cannot be backdriven to thus prevent the door from being manually slid to the open position. In another embodiment, a mechanical solenoid in the header 11 prevents the door panel 210 from being manually slid open. In either case, however, such mechanism would not prevent or inhibit the pivotal breakaway feature, at least in most embodiments.

Figure 5:
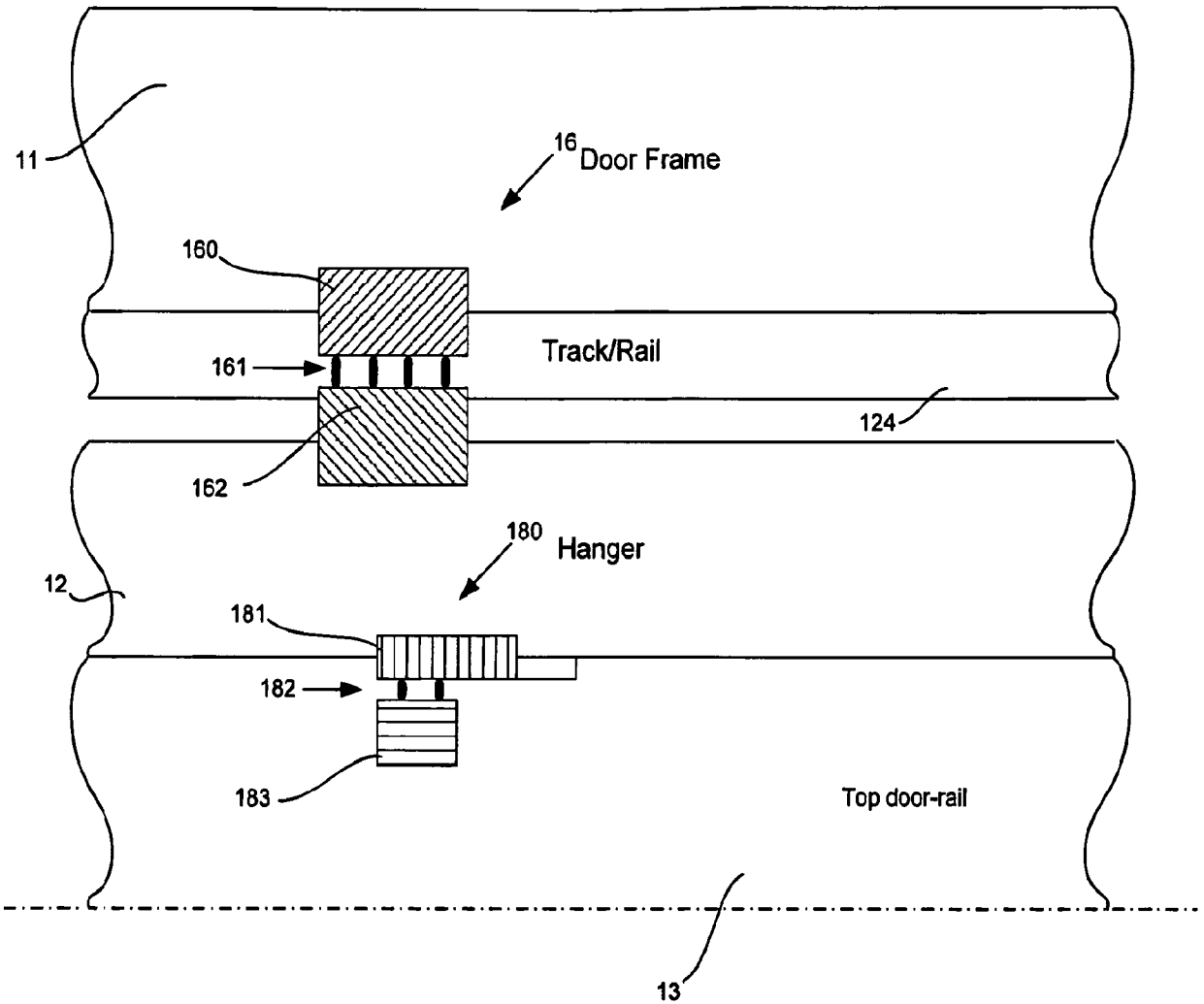
FIG. 5 illustrates communication of electrical signal and power in one embodiment of the invention.
Figure 6:
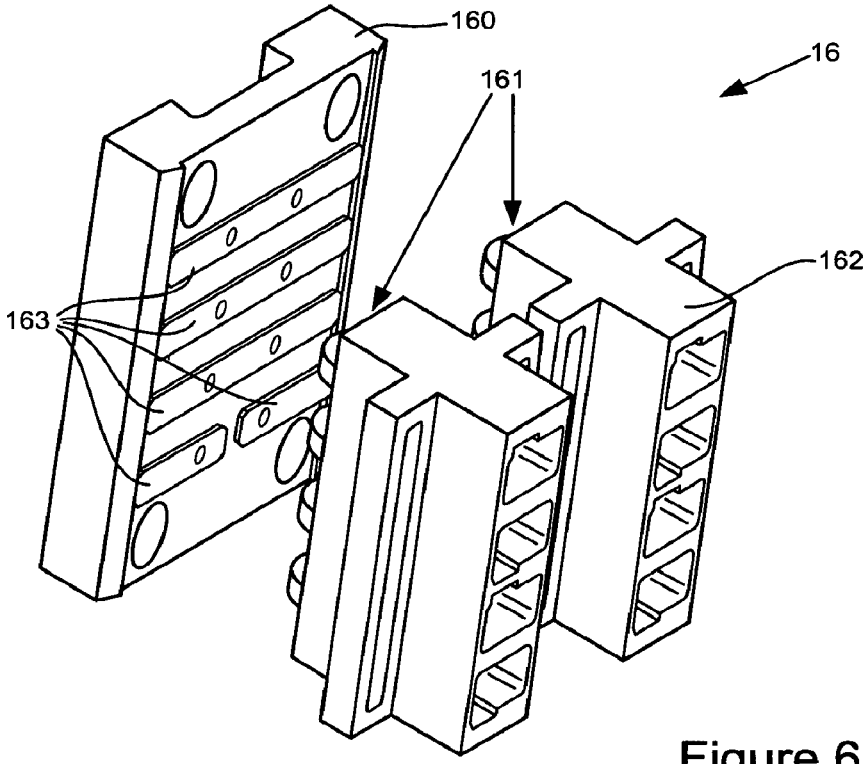
FIGS. 6 and 7 illustrate transfer contacts used in one embodiment of the invention.
Figure 7:
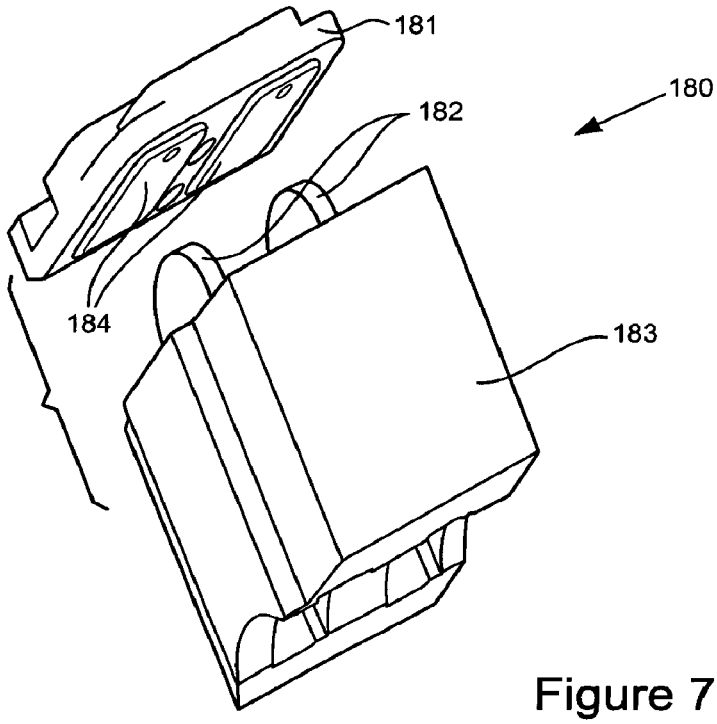

Electrical power and signals can be communicated to controller 110 using transfer contacts. FIGS. 5-7 illustrate a configuration in which transfer contacts are employed in one example of a delayed egress system. In one example, power can be provided through door frame 11 to controller 110 located in door hanger 12 using a quad transfer contact assembly shown generally at 16. Quad transfer contact assembly 16, shown in more detail in FIG. 6, is a four contact assembly that provides electrical power and signal transfer to contact pad component 160 through contacts 161 on contact pin assembly 162. In one example, spring-loaded contacts 161 make electrical contact with respective pads 163 on contact pad component 160. It will be appreciated that the positions of the contact pad component 160 and the contact pin assembly 162 can be swapped as desired or necessary. Furthermore, the positioning of the quad transfer contact 16 can be selected according to preference or to obtain certain desired operational characteristics.

Dual transfer contact 180, shown in more detail at FIG. 7, is a two contact assembly that can be positioned to provide electrical signal transfer from the top rail of door panel 210 (See FIG. 2) to door hanger assembly 12. Dual transfer contact 180 typically provides electrical power transfer from contact pad component 181 through contacts 182 on contact pin assembly 183. Typically, spring-loaded contacts 182 make electrical contact with respective pads 184 on contact pad component 181. It will be appreciated that the positions of the contact pad component 181 and the contact pin assembly 183 can be swapped as desired or necessary. Furthermore, the positioning of the dual transfer contact 180 can be selected according to preference or to obtain certain desired operational characteristics.

In another embodiment, it is contemplated that the lock(s) 14 may be provided between the frame on header 11 and the hanger 12. In such an embodiment, the hanger 12 would be mounted for pivotal movement relative to the frame 11, and the entire hanger 12 and door panel 210 would pivotally move in a breakout condition.

In one embodiment, an additional deadbolt lock can be used to mechanically lock the door panel 210 to more securely and supplementally lock the door panel. For example, such additional lock may be used at night when a store is closed.

Figure 8A:
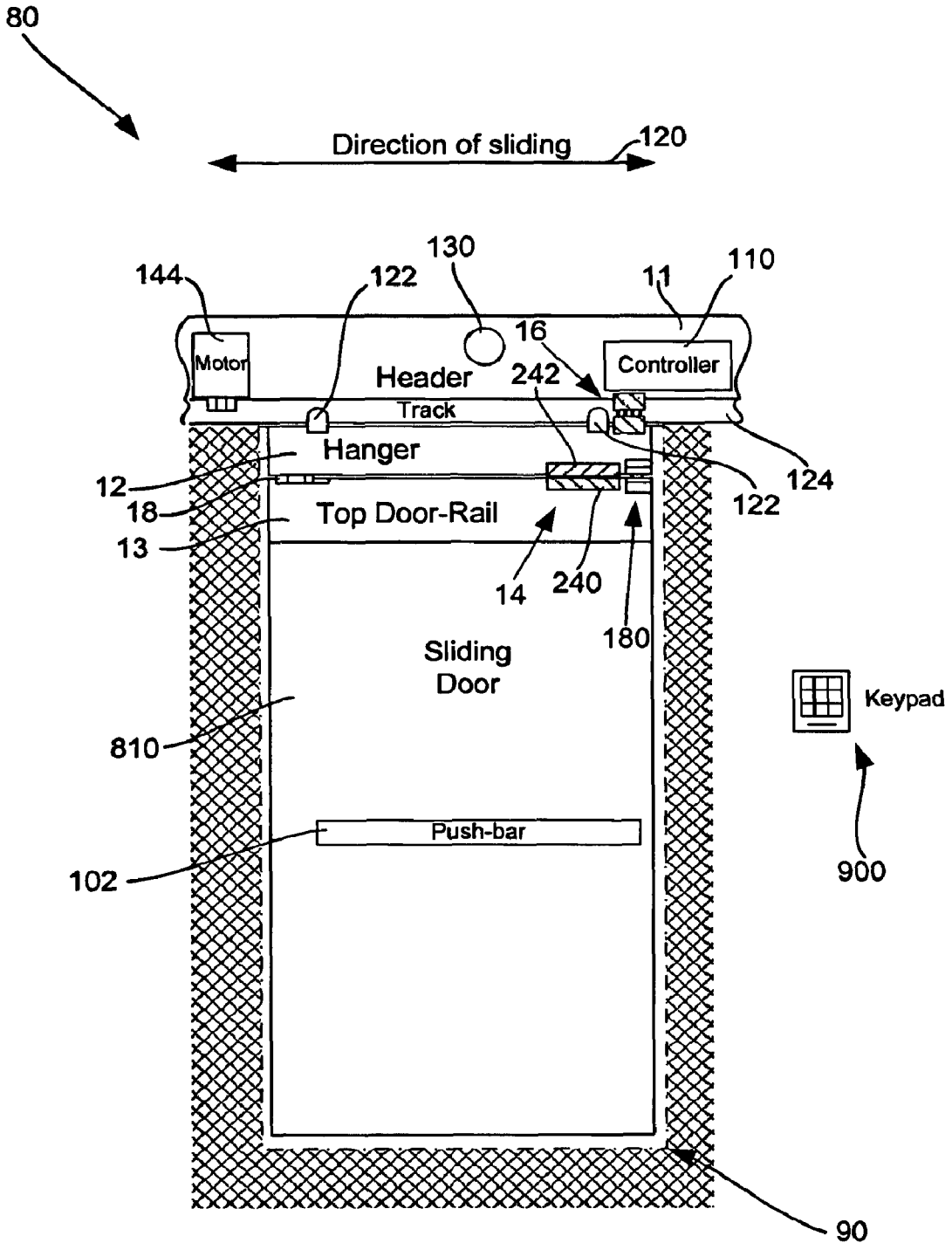
FIGS. 8A, 8B and 8C illustrate an example of an embodiment of a single-door delayed egress system.
Figure 8B:
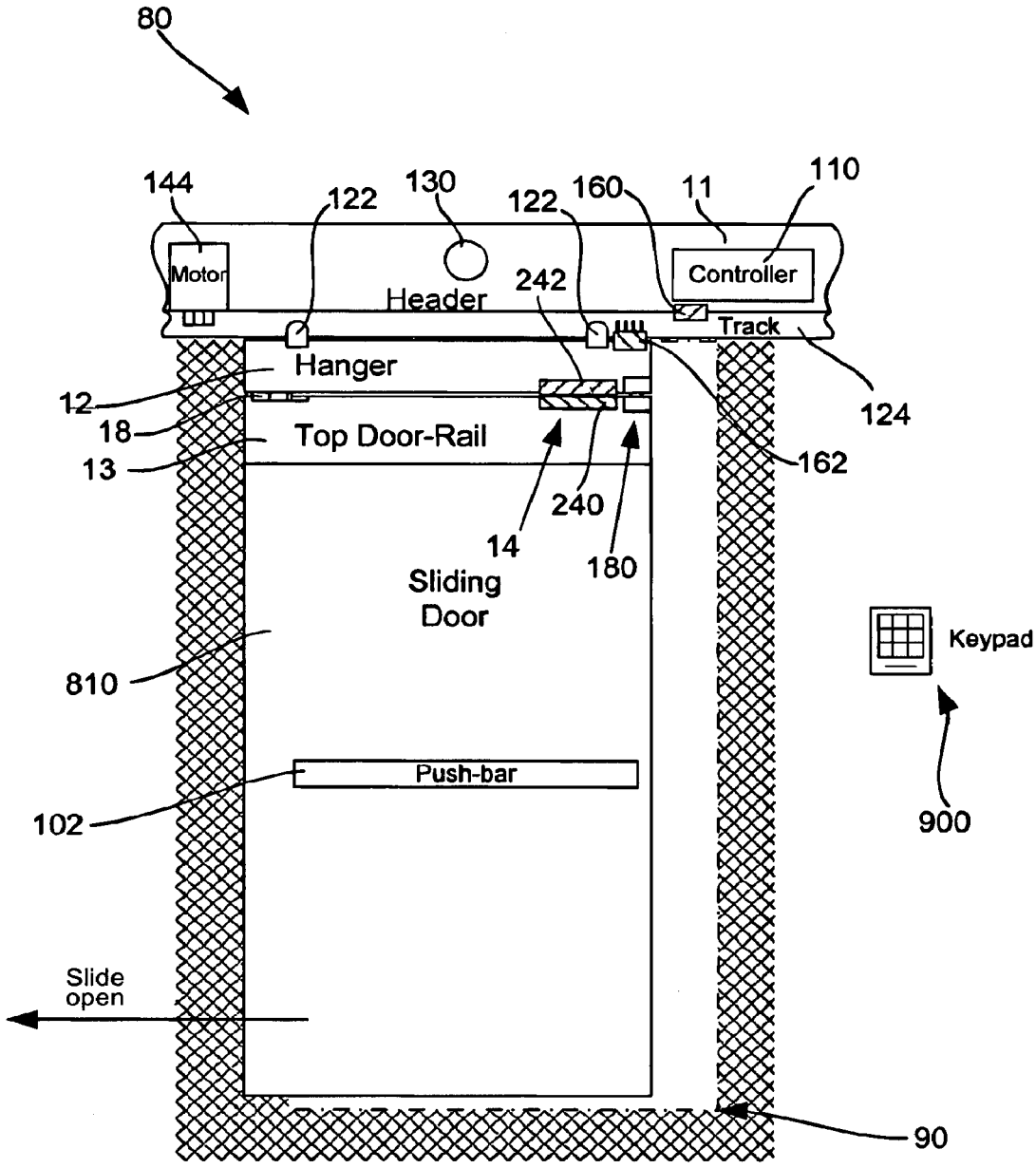
Figure 8C:
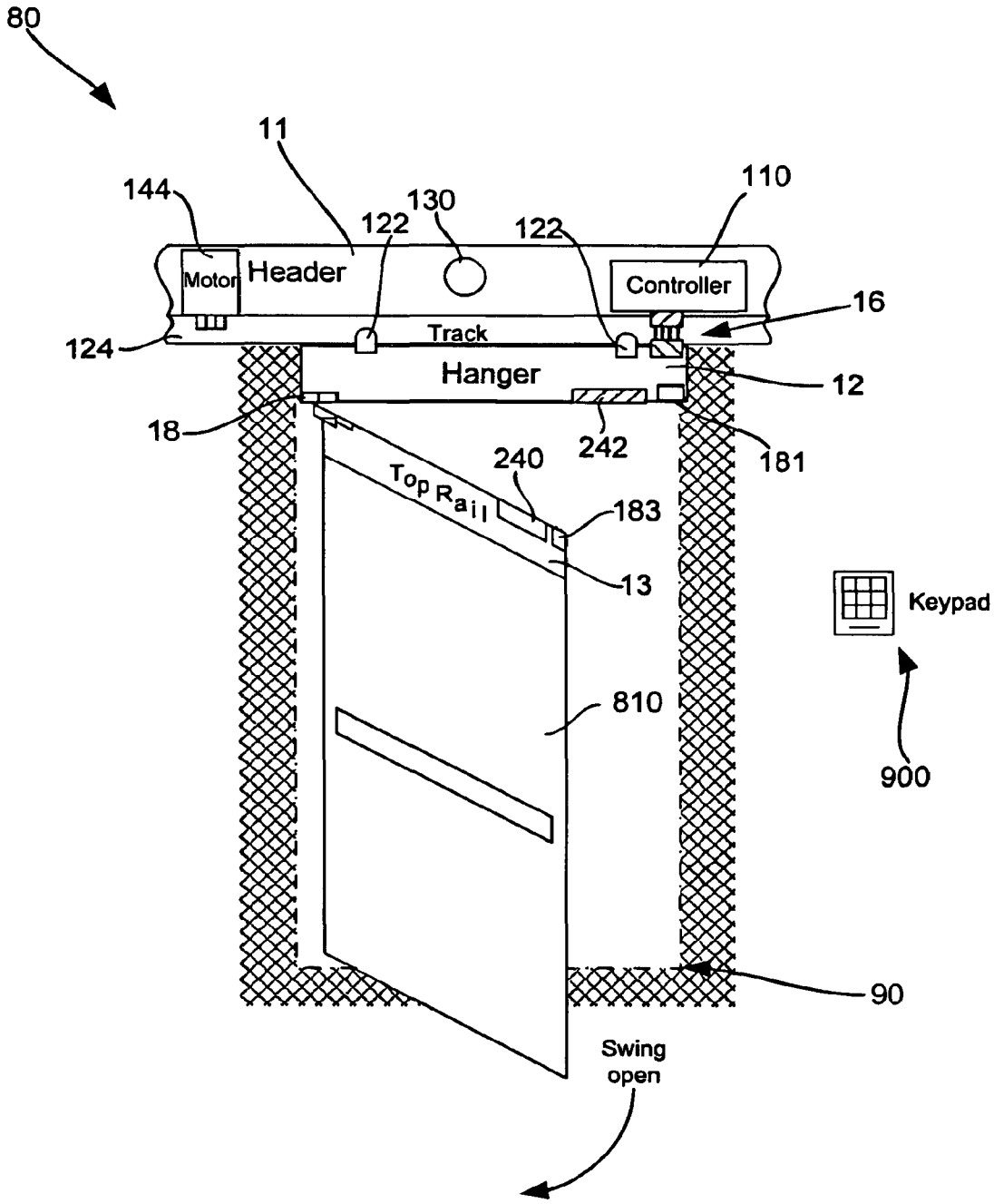

It should be appreciated that while the details provided above are described in relation to a door assembly having dual door panels 10-L and 10-R, the present invention applies equally to a single-paneled sliding door assembly 80, an example of which is depicted in FIGS. 8A, 8B and 8C. It is contemplated that the systems and methods described apply equally to single door assemblies 80 and double door assemblies 8. Thus in a double sliding door system 8, the two door panels 10-L and 10-R are disposed in an adjacent aligned relationship when in a closed position (FIG. 1A) covering an enlarged door opening 9 as known in the art. Upon a sensor 130 detecting an individual approaching the doorway, the door panels 10-L and 10-R move away from one another in opposite linear directions to expose the opening 9 therebetween (FIG. 1B). The door panels 10-L and 10-R would then return to the closed position after a predetermined period. When in the closed position, the breakaway mode will create an opening between the door panels 10-L and 10-R as the door panels 10-L and 10-R pivot to mutually open positions.

In a single sliding door system 80, the door panel 810 is disposed, when in a closed position (FIG. 8A), covering a door opening 90 as known in the art. Upon a sensor 130 detecting an individual approaching the doorway, the door panel 810 moves in one direction to expose the opening 90 (FIG. 8B). The door panel 810 would then return to the closed position after a predetermined period. When in the closed position, the breakaway mode will create an opening as the door panel 810 pivots to an open position as shown in FIG. 8C.

Although the present invention has been described with reference to specific exemplary embodiments, it will be evident to one of ordinary skill in the art that various modifications and changes may be made to these embodiments without departing from the broader spirit and scope of the invention. Accordingly, the specification and drawings are to be regarded in an illustrative rather than a restrictive sense.

What is claimed is:

1. A sliding door system comprising:

a door assembly constructed and arranged to be mounted in a door frame, the door assembly including a door panel mounted on a hanger, and a drive system, wherein the drive system linearly drives the hanger thereby causing linear movement of the door panel within the door frame between open and closed linear positions when the door panel is a linear sliding mode, the door panel being mounted for pivotal movement between a normally closed pivotal position and an open pivotal position when the door panel is in a pivoting mode, a door lock that retains the door panel in the closed pivotal position when the door is operated in the linear sliding mode, a door release operatively associated with the door, wherein the door release is operable to generate a signal when actuated, the signal indicating a request to unlock the door lock and thus enable pivotal movement of the door panel from the closed pivotal position to the open pivotal position, a controller operatively connected with the door release so as to receive the signal generated when the door release is actuated, the controller generating a door release signal to unlock the door lock to enable movement of the door panel from the closed pivotal position to the open pivotal position after a period of time subsequent to actuation of the door release, and a sensor configured to detect movement of an object proximate to the doorway, the sensor operatively connected with the drive system such that detection of such movement causes movement of the door panel from the closed linear position to the open linear position when the door is operated in the linear sliding mode.

2. The sliding door system according to claim 1, wherein the object is a person.

3. The sliding door assembly according to claim 2, wherein the door panel is pivotally mounted to the hanger.

4. The sliding door system according to claim 3, wherein the door lock retains the door panel in alignment with the hanger when the door is operated in the linear sliding mode.

5. The sliding door system according to claim 4, wherein the door lock comprises a magnetic lock.

6. The sliding door system according to claim 5, wherein the magnetic lock comprises a first portion mounted on the door panel and a second portion mounted on the hanger, wherein an energizing current provided to the magnetic lock develops a magnetic force that locks the first portion to the second portion when the door is operated in the linear sliding mode.

7. The sliding door system according to claim 2, wherein the drive system comprises a drive motor.

8. The sliding door system according to claim 7, wherein the door hanger is linearly movable along a track when driven by the drive system.

9. The sliding door system according to claim 8, wherein the track is provided on a header portion of the door frame.

10. The sliding door system according to claim 1, wherein the controller is mounted on a header portion of the door frame.

11. The sliding door system according to claim 1, wherein the door release comprises an actuator, wherein the controller switches door operation between the linear sliding mode and the pivoting mode responsive to a change in activation state of the actuator.

12. The sliding door system according to claim 11, wherein the door release further comprises a movable bar mounted on the door panel, wherein the movable bar is manually movable to actuate the actuator.

13. The sliding door system according to claim 12, wherein actuation of the actuator causes the controller to send a door release signal to the door lock to release the door lock upon expiration of a predetermined time delay after the actuator has been actuated.

14. The sliding door system according to claim 1, wherein the sliding door system has a double door configuration, wherein the door panel and door hanger are slidable in a first direction from the closed linear position towards the open linear position thereof and a second opposite direction from the open linear position towards the closed linear position thereof when the door is operated in the linear sliding mode, further comprising a mating door panel and mating door hanger that, when the mating door is operated in the linear sliding mode, are slidable in the second direction from a closed linear position of the mating door panel towards an open linear position of the mating door panel of the mating door panel and slidable in the first direction from the open linear position panel of the mating door panel towards a closed linear position of the mating door panel, the two door panels and door hangers thus movable in opposite directions when moving towards their respective open or closed linear positions, the two door panels and door hangers both being pivotally unlocked to enable pivotal movement thereof in when operated in the pivoting mode.

15. The sliding door system according to claim 1, wherein the sensor comprises a motion detector operable to cause a door opening signal to be sent to the drive system to effect linear movement of the door panel from the closed position to the open position in response to the detector detecting the approach of an individual towards the doorway.

16. The sliding door system according to claim 15, wherein the motion detector causes the door opening signal to be sent by transmitting a signal to the controller, which in turn generates the door opening signal to operate the drive system.

17. A sliding door system comprising:

a door assembly constructed and arranged to be mounted in a door frame, the door assembly including a door panel mounted on a hanger, and a drive system, wherein the drive system linearly drives the hanger thereby causing linear movement of the door panel within the door frame between open and closed linear positions when the door panel is a linear sliding mode, the door panel being mounted for pivotal movement between a normally closed pivotal position and an open pivotal position when the door panel is in a pivoting mode, a door lock that retains the door panel in the closed pivotal position when the door is operated in the linear sliding mode, a door release operatively associated with the door, wherein the door release is operable to unlock the door lock and thus enable pivotal movement of the door panel from the closed pivotal position to the open pivotal position, a controller operatively connected with the door release so as to receive a signal indicating that the door release has been actuated, the controller generating a door release signal to unlock the door lock to enable movement of the door panel from the closed pivotal position to the open pivotal position after a period of time subsequent to operation of the door release, and a sensor configured to detect movement of an object proximate to the doorway, the sensor operatively connected with the drive system such that detection of such movement causes movement of the door panel from the closed linear position to the open linear position, wherein the door release comprises an actuator that includes a switch that detects when a pivotal opening force has been applied to the door panel, and wherein the controller switches door operation between the linear sliding mode and the pivoting mode responsive to a change in activation state of the actuator.

18. A sliding door system comprising:

a door assembly constructed and arranged to be mounted in a door frame, the door assembly including a door panel hingedly mounted on a hanger and a drive system, the drive system operatively connected with the hanger to effect linear movement of the hanger and the door panel within the door frame between open and closed linear positions when the sliding door system is operated in a first mode, the door panel being mounted for pivotal movement between a normally closed pivotal position and an open pivotal position when the sliding door system is operated in a second mode, a releasable door lock that retains the door panel in the closed pivotal position when the sliding door system is operated in the first mode, a door release operatively associated with the door lock;

a controller operatively connected with the door lock and the door release wherein the controller is configured to unlock the door lock to enable pivotal movement of the door panel after a period of time subsequent to operation of the door release, wherein the controller determines current mode of the sliding door system by monitoring signals indicative of the configuration of the sliding door system, wherein the controller is selectively operable to lock or unlock the door lock to prevent or enable pivotal movement of the door panel, wherein the door panel automatically slides between open and closed positions to allow passage of an individual in normal operation upon detection of the approach of the individual.

19. A secured doorway comprising:

a door hanger constructed and arranged to be slidably mounted in a door frame;

a door panel having a top rail, wherein one end of the top rail is hingedly attached to the door hanger at an attachment point;

an electromagnetic shear lock having a magnet on the top rail and an armature mounted on the door hanger, the magnet and armature being disposed at generally equal distances from the attachment point, wherein an energizing current provided to the magnet activates the shear lock when the magnet and armature are proximate to one another, and wherein the shear lock is activated in a first operating mode in order to maintain planar alignment of the door panel with the door hanger;

a first sensor configured to detect an individual approaching the doorway wherein, in the first operating mode, the door hanger and the door panel are automatically linearly driven to a linear open position upon detecting the approach of the individual; and a second sensor configured to enable a second operating mode responsive to an input received from the individual and, in the second operating mode, further configured to generate a request signal that causes the shear lock to be deactivated thereby permitting the door panel to rotate about the attachment point, wherein the shear lock responds to an override signal that either inhibits deactivation of the shear lock or forces deactivation of the shear lock;

wherein the second sensor comprises a push bar configured to generate the request signal when pushed, wherein the controller deactivates the shear lock responsive to the request signal in the second operating mode;

wherein the override signal inhibits deactivation of the shear lack when asserted.

20. The secured doorway of claim 19, wherein the override signal is asserted by a key switch.

21. A secured doorway comprising:

a door hanger constructed and arranged to be slidably mounted in a door frame;

a door panel having a top rail, wherein one end of the top rail is hingedly attached to the door hanger at an attachment point;

an electromagnetic shear lock having a magnet on the top rail and an armature mounted on the door hanger, the magnet and armature being disposed at generally equal distances from the attachment point, wherein an energizing current provided to the magnet activates the shear lock when the magnet and armature are proximate to one another, and wherein the shear lock is activated in a first operating mode in order to maintain planar alignment of the door panel with the door hanger;

a first sensor configured to detect an individual approaching the doorway wherein, in the first operating mode, the door hanger and the door panel are automatically linearly driven to a linear open position upon detecting the approach of the individual; and a second sensor configured to enable a second operating mode responsive to an input received from the individual and, in the second operating mode, further configured to generate a request signal that causes the shear lock to be deactivated thereby permitting the door panel to rotate about the attachment point, wherein the shear lock responds to an override signal that either inhibits deactivation of the shear lock or forces deactivation of the shear lock;

wherein the second sensor comprises a push bar configured to generate the request signal when pushed, wherein the controller deactivates the shear lock responsive to the request signal in the second operating mode;

wherein the override signal forces deactivation of the shear lock when asserted.

22. The secured doorway of claim 21, wherein the override signal is asserted by a key switch.

23. The secured doorway of claim 21, wherein the shear lock is deactivated following a predetermined delay after the request signal is asserted.

24. The secured doorway of claim 23, wherein the predetermined delay is greater than 5 seconds.

25. The secured doorway of claim 23, wherein the override signal inhibits deactivation of the shear lock when asserted.

26. The secured doorway of claim 25, wherein the controller is provided in the door hanger.

27. A delayed egress door operable in sliding mode and in pivoting mode, the door being attached at an attachment point to a hanger slidably mounted in a doorway, comprising:

an electromagnetic shear lock including a first portion mounted on a top rail of the door and a second portion mounted in the door hanger, wherein the first and second portions are proximate to one another when the door is in planar alignment with the doorway;

a controller configured to control a current provided to the electromagnetic shear lock, wherein the current is controlled to activate the electromagnetic shear lock while the delayed egress door is in the sliding mode and deactivate the electromagnetic shear lock while the delayed egress door is in the pivoting mode; and an egress switch configured to provide an egress signal to the controller, wherein the egress signal causes the controller to initiate a delayed egress sequence when asserted, the delayed egress sequence includes a delay period initiated when the egress switch is activated, wherein the delayed egress door is operated in the pivoting mode such that the door is rotatable about the attachment point, after the delay period, and wherein the door automatically slides open upon detection of an individual approaching the door when the delayed egress door is operated in the sliding mode.

28. The delayed egress door of claim 27, wherein the delayed egress sequence is initiated when the egress signal is asserted for a first predetermined time period.

29. The delayed egress door of claim 28, wherein the delayed egress sequence includes a second predetermined time period and wherein the controller is configured to deactivate the electromagnetic shear lock after expiration of the second time period.

30. The delayed egress door of claim 29, wherein the door is automatically closed prior to commencement of the second predetermined time period.

31. A secured doorway comprising:

a door hanger constructed and arranged to be slidably mounted in a door frame;

a door panel having a top rail, wherein one end of the top rail is hingedly attached to the door hanger at an attachment point;

an electromagnetic shear lock having a magnet on the top rail and an armature mounted on the door hanger, the magnet and armature being disposed at generally equal distances from the attachment point, wherein an energizing current provided to the magnet activates the shear lock when the magnet and armature are proximate to one another, and wherein the shear lock is activated in a first operating mode in order to maintain planar alignment of the door panel with the door hanger;

a first sensor configured to detect an individual approaching the doorway wherein, in the first operating mode, the door hanger and the door panel are automatically linearly driven to a linear open position upon detecting the approach of the individual; and a second sensor configured to enable a second operating mode responsive to an input received from the individual and, in the second operating mode, further configured to generate a request signal that causes the shear lock to be deactivated thereby permitting the door panel to rotate about the attachment point, wherein the shear lock responds to an override signal that either inhibits deactivation of the shear lock or forces deactivation of the shear lock;

and further comprising an override switch which, when activated, causes the override signal to be generated.

32. The secured doorway of claim 31, wherein the controller deactivates the shear lock responsive to a signal received from the second sensor in the second operating mode.

* * * * *